United States Patent [19]

Budecker et al.

[11] Patent Number: 4,555,223

[45] Date of Patent: Nov. 26, 1985

[54] RADIAL PISTON MACHINE

[75] Inventors: Ludwig Budecker; Georg Obersteiner, both of Frankfurt am Main, Fed. Rep. of Germany

[73] Assignee: ITT Industries, Inc., New York, N.Y.

[21] Appl. No.: 605,996

[22] Filed: May 3, 1984

Related U.S. Application Data

[63] Continuation of Ser. No. 365,676, Apr. 5, 1982, abandoned.

[30] Foreign Application Priority Data

May 29, 1981 [DE] Fed. Rep. of Germany ..... 3121528

[51] Int. Cl.[4] ..... F04B 19/20; F04B 29/00; F16J 9/00

[52] U.S. Cl. ..... 417/462; 92/240; 92/247; 92/248; 91/488

[58] Field of Search ..... 91/491, 492, 488; 417/462; 92/240, 247, 248

[56] References Cited

U.S. PATENT DOCUMENTS

| | | | |
|---|---|---|---|
| 2,855,858 | 10/1958 | Larson et al. | 417/462 |
| 2,884,292 | 4/1959 | Doner | 92/245 |
| 3,008,781 | 11/1961 | Milster | 92/245 |
| 3,084,633 | 4/1963 | Henrichsen | 91/488 |
| 3,249,020 | 5/1966 | Albertsen | 91/501 |
| 3,272,079 | 9/1966 | Bent | 92/249 |
| 3,366,017 | 1/1968 | Firth et al. | 91/498 |
| 3,435,774 | 4/1969 | Parrett | 91/501 |
| 3,783,748 | 1/1974 | Cunningham | 92/249 |
| 3,955,476 | 5/1976 | David | 91/491 |
| 4,144,798 | 3/1979 | Cyphelly | 91/488 |

FOREIGN PATENT DOCUMENTS

| | | | |
|---|---|---|---|
| 2368619 | 5/1978 | France | 91/488 |
| 161981 | 12/1980 | Japan | 92/248 |
| 1487301 | 9/1977 | United Kingdom | 91/501 |

*Primary Examiner*—William L. Freeh

*Attorney, Agent, or Firm*—James B. Raden; William J. Michals

[57] ABSTRACT

In a radial piston machine, there is provided an outer stator and an inner rotor rotatable on a control pintle provided with supply and discharge channels. The rotor contains at least one radial bore in which is slidable a spherical piston comprising an outer ball and an inner cylindrical sleeve. The radially inward end of the sleeve, which end is adapted to be acted upon by the outlet pressure of the machine, includes a sealing lip which, during operation, in particular at higher pressures, expands circumferentially and, under certain circumstances, moves in sealing abutment with the inner wall of the radial bore.

1 Claim, 3 Drawing Figures

RADIAL PISTON MACHINE

This application is a continuation, of application Ser. No. 365,676, filed Apr. 5, 1982 now abandoned.

BACKGROUND OF THE INVENTION

The present invention relates to a radial piston machine with at least one spherical piston, and more particularly to a spherical piston pump, whose balls adapted to roll on an outer cam ring or stator are connected rotatably to a cylindrical sleeve which slides in a sealed manner in a radial bore of a rotor rotatable on a stationary control pintle which is provided with supply and discharge channels.

A spherical piston machine of the construction referred to hereinabove is known from German Patent DE-OS No. 2,908,096. The slidable cylindrical sleeve disposed in a snug fit relative to the rotor's radial bore leaves a gap between rotor and sleeve due to which losses caused by leaks have to be put up with, which impair the efficiency of the machine, in particular in the event of higher pressures and/or the operating medium being of low viscosity.

SUMMARY OF THE INVENTION

It is an object of the present invention to improve upon the known spherical piston machine to the end that good efficiency is attained even at higher pressures and/or with the operating medium being of low viscosity with the aid of simple constructive means.

A feature of the present invention is the provision of a radial piston machine comprising a stator; a rotor disposed in the stator and rotatable on a stationary control pintle having supply and discharge channels; a radial bore disposed in the rotor connected to the supply and discharge channels; and at least a pair of radially displaceable spherical pistons disposed at opposite ends of the radial bore, each of the pistons including a ball adapted to roll on a cam surface disposed in the stator and a cylindrical sleeve having one end thereof connected rotatably to the ball, each of the sleeves include a sealing lip disposed on the other end thereof remote from the ball subjected to outlet pressure of the machine.

The invention makes use of the pressure of the operating medium on the pressure side to provide exact sealing between rotor and stator. During operation, the elastic sealing lip expands in a radial direction of the sleeve, the gap between sleeve and rotor being reduced or completely closed thereby. The sleeve makes it possible to overlap a great length of the bore. When the sealing lip is in abutment on the rotor during operation, a line contact is created which practically does not impair the slidability of the spherical piston element.

In an advantageous improvement of the present invention, the sleeve and sealing lip are made of the same material and are integral. This affords ease of manufacture of the seal-piston element.

In particular, the material of the sleeve and sealing lip has a coefficient of thermic expansion higher than that of the rotor. This causes further reduction of the gap between sleeve and rotor at higher operating temperatures so that the volumetric efficiency will be improved even if the operating medium is of low viscosity.

Expediently, the radially outward end of the sleeve receives the ball of the spherical piston in a socket-type manner, with the ball being substantially in line contact with the sleeve. As a consequence, the sleeve is disposed substantially in an extension of the associated ball without enclosing the ball, as is the case, for instance, according to the above-cited German Patent. This permits a further reduction in the mass of the oscillating ball-sleeve element, and both single members are able to not only be manufactured separately, but, when assembled, to also be replaced separately in case of a defect.

Advantageously, the axially- symmetric sleeve contains a concentric axial passageway. Due to this, the ball is acted upon by hydraulic pressure directly during operation and the mechanic contact between ball and sleeve is relieved from load without the sealing effect being appreciably impaired.

Straightforward embodiments of the present invention enable the ball element of a piston to be disposed in nonsnug fit relative to the radial bore of the rotor, because, in many modes of application, there is no need for a well fitted ball with a small running clearance owing to the provision of the interposed sleeve element which takes care of the sealing. In a special embodiment, however, there is provided a snug fit of the ball in the radial bore of the rotor, the outer diameter of the sleeve being substantially the ball diameter. In this case, there is created an additional seal between ball and rotor.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
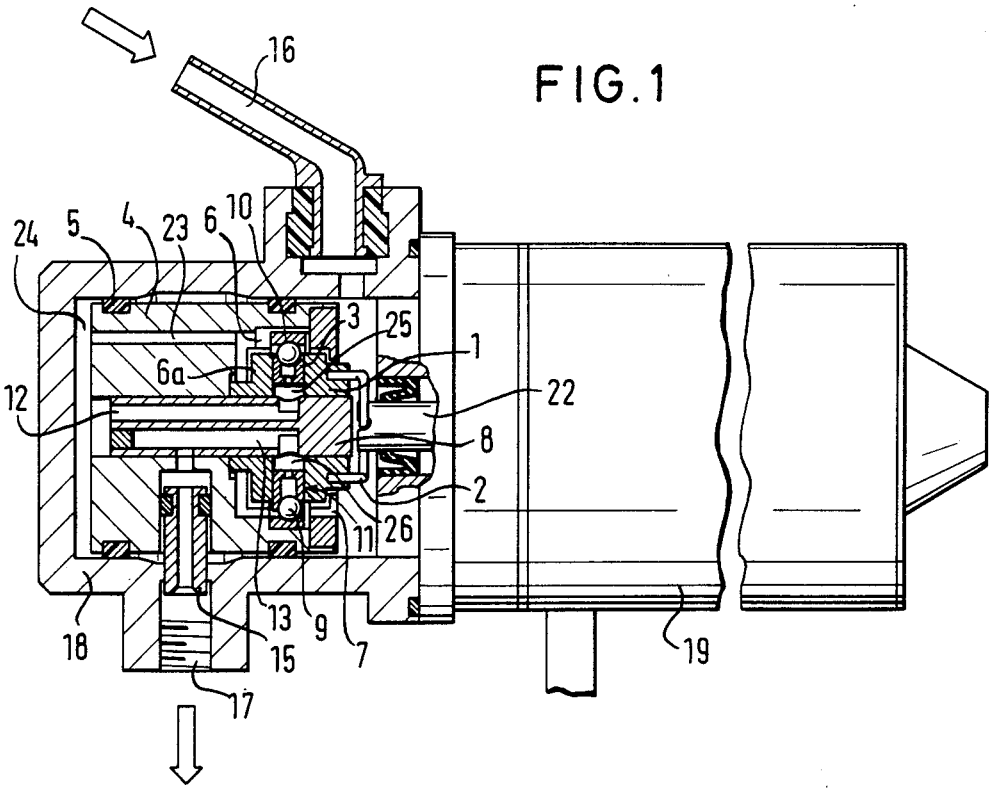
FIG. 1 is a longitudinal cross sectional view of a spherical piston pump in accordance with the principles of the present invention.
Figure 2:
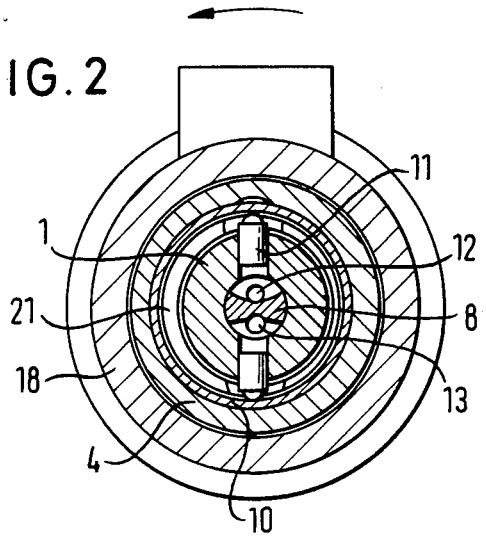
FIG. 2 is a transverse cross sectional view of the pump of FIG. 1 in the area of the axis of the spherical piston.

The spherical piston pump according to FIGS. 1 and 2 comprises a cup-type housing 18, closed on the one end face, having a suction port 16 and a pressure port 17 on the housing periphery.

The interior of housing 18 accommodates a rotor-and-stator unit which is supported in housing 18 through elastic sealing supporting members 5 having the shape of O-rings, in order to enable the pump to operate at a low noise level. Beside by the elastic sealing member 5, the rotor-and-stator unit is held in a torsionally secured position relative to housing 18 by an insert 15 inserted in pressure port 17 between housing 18 and stator 4, with no metallic contact taking place between insert 15 and stator 4, due to the presence of further elastic supporting members with sealing effect.

The rotor-and-stator unit comprises substantially an outer stator 4 and an inner rotor 1 which is rotatably seated on the one end (according to FIG. 1, the right end) of a central control pintle 8, control pintle 8 being received in an internal bore of the stator 4 and possessing a supply channel 12 as well as a discharge channel 13 to and from the rotor interior.

The one end wall of rotor 1 is connected to one end of a connected shaft 22 of an electric motor 19 via an axially and torsionally elastic spring clutch 2, the connected shaft 22 being disposed in a coaxial extension of the rotor 1.

The interior of rotor 1 contains a radial throughbore. Arranged therein are diametrically opposite, radially displaceable spherical pistons 11 whose outer balls 9 roll on an eccentric cam ring 10 which is supported slidably in the outer stator 4.

When the spherical piston pump is operated, rotation of rotor 1 causes hydraulic fluid to be drawn in through suction port 16 on the suction side 7 of the pump, which is pressurized adjacent the circumferential chamber 21 of FIG. 2 and fed to the pressure side compartment 6 of the pump via a longitudinal bore 23 of the stator 4, via a compartment 24 and the supply channel 12 to the suction chamber 25 on the radially inner side of the spherical piston 11 and, after another half rotation of the rotor 1, will be discharged via the pressure chamber 26, the discharge channel 13 of the control pintle 8 and the pressure port 17 of the pump. In this arrangement, centrifugal force and the working pressure urge the spherical pistons 11 outwardly against cam ring 10. The device being in operation, the rotor will be urged in an axial direction against the spring clutch 2 of the connected shaft 22 by the pump pressure generated in the compartment 6, *6a*, resulting in the unit being retained in an axially centered position clear of contact relative to housing 18.

Figure 3:
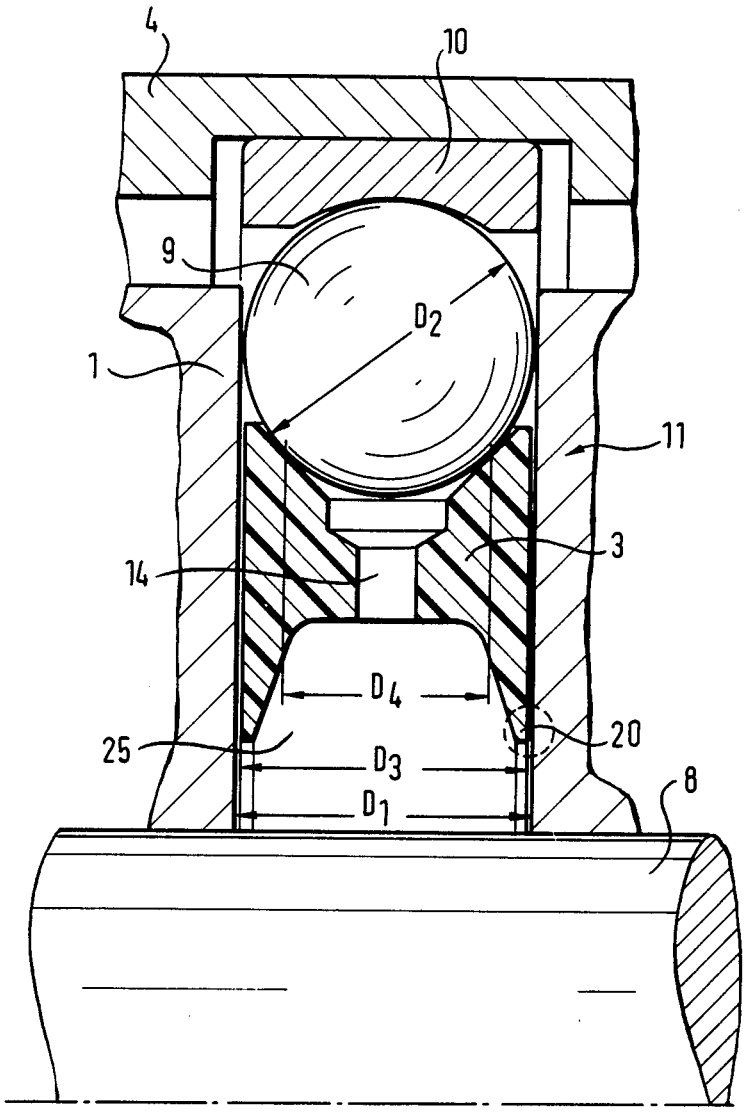
FIG. 3 is a schematic cross sectional view of a detail of the pump of FIG. 1 on an enlarged scale.

The radial bore of the rotor 1 houses a spherical piston 11 which is schematically shown in FIG. 3 on an enlarged scale.

The radially outward end of the sleeve 3 receives the ball 9 in a socket-type manner adjacent a mean ball diameter $D_4$.

The radially inward circumferential end of sleeve 3 bounds a part of the pressure chamber 25 and is constructed as an integral sealing lip 20 having a specific elasticity with relation to the radial bore of rotor 1.

The diameter $D_1$ of the radial bore is slightly larger than the outer diameter $D_3$ of the sleeve 3 enabling the outer periphery of the sleeve 3 to provide a gap seal relative to the rotor 1 outside the area of the sealing lip 20. The ball diameter $D_2$ corresponds approximately to the outer diameter $D_3$ of the sleeve.

With the spherical piston pump in operation, the pressure chamber 25 is acted upon by hydraulic pressure. At low pressures and/or at high degrees of viscosity (low temperatures), the sealing effect between ball diameter $D_2$ and spherical piston bore $D_1$ will be primarily sufficient. At higher pressures, the sealing lip 20 of the piston, which is made preferably of fiber-filled polytetraflourethylene, will be expanded in a circumferential direction causing reduction of the gap between sleeve 3 and piston bore to provide an additional seal. Due to the abutment of the sealing lip 20 on the piston bore and due to precise abutment of the ball 9 on the sleeve 3 adjacent the diameter $D_4$, there will be no more need for a sealing of the ball 9 at the diameter $D_2$. Sleeve 3 will be urged against the ball 9 in the vicinity of the diameter $D_4$ by a force which results from the pressure acting on the surface $F=(D_1-D_4)^{2\cdot\pi/4}$.

The coefficient of thermic expansion of the sleeve material is higher than that of the enclosing rotor 1. As a result, the gap between $D_1$ and $D_3$ will be reduced at higher temperatures and the volumetric efficiency of the pump improved. The seal at the diameter $D_4$ will be effective also in the case of the sleeve 3 having a higher coefficient of thermic expansion and the pump being subjected to higher operating temperatures.

While we have described above the principles of our invention in connection with specific apparatus, it is to be clearly understood that this description is made only by way of example and not as a limitation to the scope of our invention as set forth in the objects thereof and in the accompanying claims.

We claim:

1. A radial piston machine for transmitting fluid therethrough, said machine comprising a stator, a rotor disposed in said stator and rotatable on a stationary control pintle having supply and discharge channels, a radial through-bore in said rotor adapted for periodic connection to said supply and discharge channels, said through-bore containing a first and a second radially displaceable spherical piston disposed at opposite ends of the bore on opposed sides of the control pintle, each piston including a radially outwardly disposed ball seated in a radially inwardly disposed unitary cylindrical sleeve, with each piston radially slidable relative to a cam surface on said stator, each said sleeve comprising a cylindrical outer wall of uniform diameter and circumference each sleeve including an axially concentric through passage having a conic seat for its associated ball at one end to provide a line contact therewith, and in which said passage bounds an outwardly tapering wall of said sleeve at the other end of said sleeve forming a peripheral integral sleeve lip positioned to sealingly engage the adjacent bore wall with a gap sealing lip responsive to pressure above a predetermined level passing through said passage.

* * * * *